United States Patent [19]

Larsson et al.

[11] Patent Number: 4,760,970

[45] Date of Patent: Aug. 2, 1988

[54] FEEDING OUT DEVICE FOR A MATERIAL WEB WITHDRAWABLE FROM A ROLL

[76] Inventors: Ralf Larsson, Brovaktaregatan 37, S-431 36 Mölndal; Ove Larsson, Nedre Fogelbergsgatan 5, S-411 28 Göteborg, both of Sweden

[21] Appl. No.: 879,127

[22] PCT Filed: Oct. 11, 1985

[86] PCT No.: PCT/SE85/00392

§ 371 Date: Aug. 12, 1986

§ 102(e) Date: Aug. 12, 1986

[87] PCT Pub. No.: WO86/02247

PCT Pub. Date: Apr. 24, 1986

[30] Foreign Application Priority Data

Oct. 12, 1984 [SE] Sweden ..... 8405108

[51] Int. Cl.[4] ..... B65H 19/00

[52] U.S. Cl. ..... 242/55.54; 225/79; 242/55.53

[58] Field of Search ..... 242/55.53, 55.2, 173, 242/55.54; 206/409, 53; 225/52, 77, 79

[56] References Cited

U.S. PATENT DOCUMENTS

| | | | |
|---|---|---|---|
| 1,135,470 | 4/1915 | Tolman | 242/173 |
| 1,819,122 | 8/1931 | Resnati | 242/55.54 |
| 2,738,145 | 3/1956 | Taylor | 242/173 X |
| 2,749,056 | 6/1956 | Jenkins | 242/55.2 |
| 3,002,668 | 10/1961 | Castelli | 225/52 |
| 3,246,815 | 4/1961 | Aronson | 225/44 |
| 3,592,340 | 7/1971 | Hoey | 206/53 X |
| 4,171,047 | 10/1979 | Doyle | 206/409 X |
| 4,177,897 | 12/1979 | Cole | 206/389 |
| 4,332,324 | 6/1982 | Howard et al. | 206/389 |
| 4,524,895 | 6/1985 | Lunden | 225/77 X |

FOREIGN PATENT DOCUMENTS

| | | | |
|---|---|---|---|
| 475989 | 8/1951 | Canada | 225/52 |
| 304363 | 9/1968 | Sweden . | |
| 419742 | 8/1981 | Sweden . | |
| 423527 | 5/1982 | Sweden . | |
| 618862 | 8/1980 | Switzerland . | |

*Primary Examiner*—Stuart S. Levy
*Assistant Examiner*—Katherine Matecki
*Attorney, Agent, or Firm*—Cushman, Darby & Cushman

[57] ABSTRACT

A dispenser for dispensing a web downwardly from a vertically arranged tubular roll of the web provides for preventing unwanted dispensing of the web under the influence of gravity. Each unwanted dispensing is achieved by applying a restraining force to an appropriate location on the roll or on the web, the force being of a magnitude such that the web is restrained against unwinding by gravity yet the web can be pulled downwardly from the roll without tearing. The restraining force can be applied in any of several ways including applying a strip of adhesive tape to one end of the roll, pressing a groove into one end of the roll, applying adhesive spots at spaced intervals along the web before it is wound into a roll or by providing a mechanical arm or the like which presses against the periphery of the roll.

11 Claims, 3 Drawing Sheets

FEEDING OUT DEVICE FOR A MATERIAL WEB WITHDRAWABLE FROM A ROLL

The present invention relates to a feeding out or dispensing device for a material web, particularly a paper web, withdrawable from a preferably vertically supported tubular roll, said paper web being axially unwindable preferably from the inside of the roll.

BACKGROUND OF THE INVENTION

Dispensers for paper webs wound on an annular roll wherein the web is unwound from the inside of the roll through one end of the central hollow space of the roll are known. One disadvantage of these known dispensers is that the paper web often is in wound non-planner condition—when withdrawing it from the dispenser for tearing it off, which considerably makes the handling of the paper more difficult.

Another disadvantage with the known dispensers is that when "loading" the dispenser with a new roll, or if the paper is torn off inside the dispenser, the withdrawal of the paper end is complicated and hazardous because the hand has to be inserted into the dispenser from the bottom and might be in touch with the sharp edge at the outlet of the dispenser.

OBJECTS AND FEATURES OF THE INVENTION

The object of present invention is to provide dispenser especially for paper qualities for which the paper falls by gravitation, and which dispenser has a simple construction and is cheap to produce. The dispenser feeds the paper out in planar state and always unwinds the same dispensed quantity, which is comfortable to operate, which minimizes the risk for injuries during tearing off, and which is easy to "load" with a new roll. These functions are provided by a force arranged to act upon at least the inner or outer material part of the material web, located within the roll as seen in the unwinding direction, for arresting the material web to the roll.

DESCRIPTION OF THE EMBODIMENTS

Figure 1:
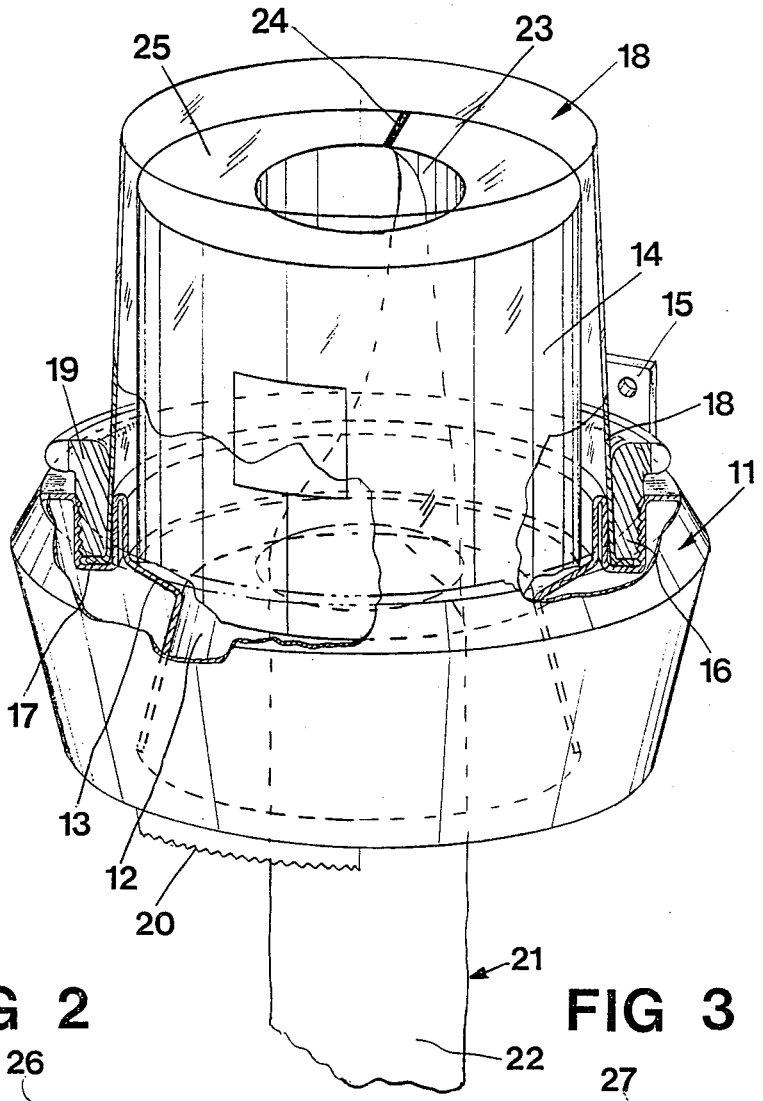
FIG. 1 shows in perspective a dispenser according to the invention, partly in section.

The dispenser according to the in FIG. 1 shown embodiment consists of a "disk-shaped" holder 11 provided with a central inner opening 12, which is surrounded by a seat 13 for a vertically positioned paper roll 14. At the disk 11 there is arranged a bracket-like attachment 15, by which the dispenser can be hung on a wall. The disk 11 is further formed with a ring-shaped groove 16, in which the open edge 17 of a cover 18 is placeable. The cover is preferably made by a transparent plastic material, so that the roll 14 inside the cover can be observed. The cover 18 is locked to the disk 11 in a suitable way, and such a way is shown in FIG. 1, where the edge 17 of the cover, provided with a flange, is held in position by a ring-shaped nut 19. A tear-off edge is indicated with the numeral 20.

The paper web 21 of the roll 14 is unwound from the inside of the roll by the end part 22 of the paper web 21 passing through the inner hollow space 23 of the roll. To prevent the paper web from reeling off by falling out by gravity there is a force acting upon the paper web, said force arresting the paperweb to the roll. First after the force is overcome a selected amount of paper can be reeled off from the roll, until a force arrests the paper track to the roll again and stops continued reeling off. In the embodiment shown in FIG. 1 this force is provided by an adhesive force, which should be a little less than the tearing strength of the paperweb, or if the paperweb is provided with perforations, serving as fractural indications, the adhesive power should be less than the tensile strength of said fractural indications. The adhesive source is suitably provided by a string 24 of an adhesive material, which is positioned radially above one, preferably the upper, end face 25 of the roll 14. The adhesive string 24 is positioned and has such an extension that it acts upon each paper web layer. Of course, more than one such adhesive string 24 can be placed on one or even both end faces 25.

Thus, when tearing off the paper web from the roll the adhesive string 24 will stop the continued unwinding of the web when the manual pulling force on the paper web has ceased.

Figure 2:
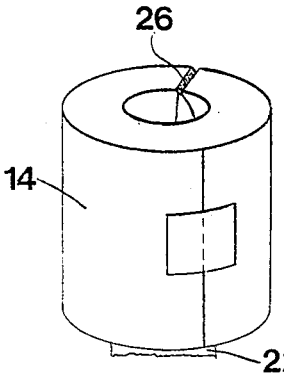
FIG. 2 shows in perspective a modified paper roll intended for the dispenser according to FIG. 1.
Figure 3:
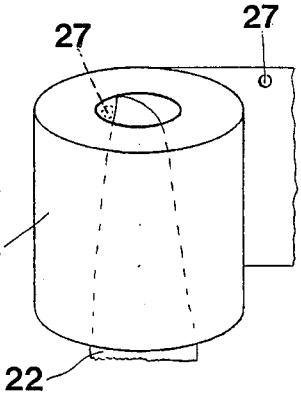
FIG. 3 shows a view analogous to FIG. 2 of a further variant of a paper roll.

Instead of an adhesive string the adhesive force can also be provided by means of a deformation zone 26, which has been provided by a groove or the like which has been pressed into the end face of the roll 14 to provide a mechanical adhesion between the separate paper web layers, as shown in FIG. 2. The adhesion force need not be placed on one or both ends of the roll 14, but can also be provided by adhesive spots 27 distributed on equal distances, which arrests the paper web layers to each other according to what is shown in FIG. 3.

Figure 4:
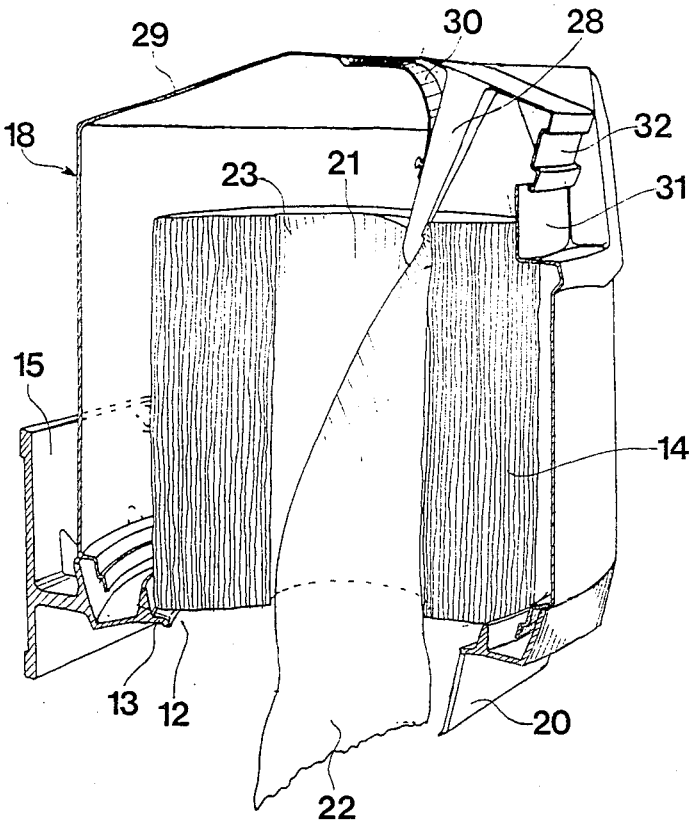
FIG. 4 shows a modified embodiment of the dispenser, partly in section.

In the embodiment according to FIG. 4 the force, which arrests the end part of the papertrack to the roll, is mechanically provided by means of a stop arm 28, which is pivotally supported at the roof 29 of the cover 18. Suitably the stop arm 28 is made integral with the cover, and the hinge is formed as a plastic hinge. the stop arm 28 cooperates with a leaf spring 30, which presses the stop arm to bear against the inner paper web 21 of a paper roll 14 and the entire roll to bear against a holder 31, which is a part of the cover 18. Integrated with the stop arm 28 there is arranged an operating arm 32, by which the stop arm is turned from its arresting position against the inner paper web 21 of the roll 14, so the paper web can be freely unwinded from the roll. As soon as the force against the operating arm 32 is released the stop arm will be turned back to bear against the inside of the roll and continued unwinding will be stopped. It is also possible to make the stop arm 28 separated from the operating arm 32 and to design the latter so that it only momentaneously lifts the stop arm thereby letting a selected length of the paper web out.

When loading the dispenser, the cover 18 shall be lifted from the disk 11, after which a new roll is placed on the same. The cover is tipped over the roll 14 and the operating arm 32 is pressed in so the stop arm 28 can be inserted into the hollow space 23 of the roll 14.

In this embodiment the spring power from the leaf spring 30 can be much bigger than the tearing or tensile strength of the paper web, because the feeding out of the paper web is regulated with the operating arm 32.

Figure 5:
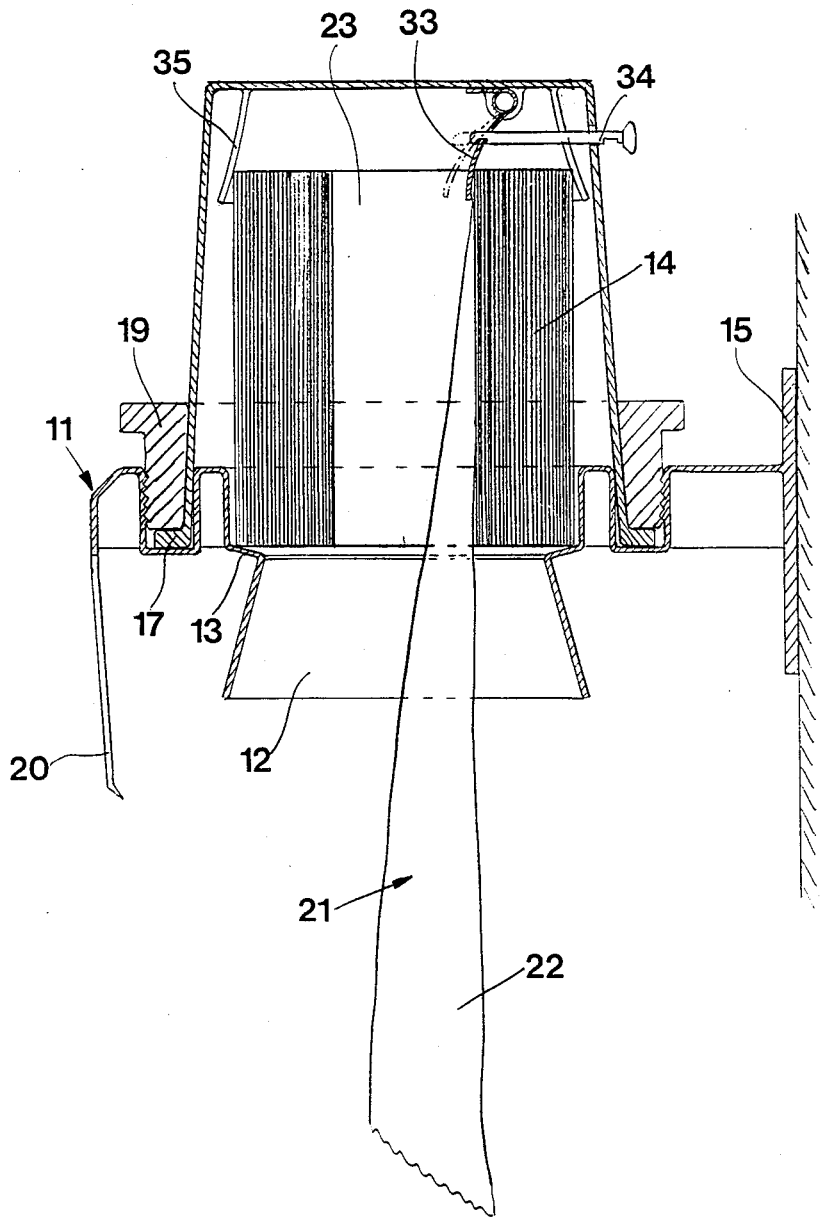
FIG. 5 shows a section through a third variant of the dispenser.

In the embodiment according to FIG. 5 the paper web is kept inside the free end part 22 in the same way as in FIG. 4 by a leaf spring 33, but the spring acts directly on the paper roll 14. By means of an operating arm 34 the spring 33 can be locked in a folded out position, in which the spring is not acting on the roll, for instance when a new roll is to be placed into the dispenser. By displacing the operating arm 34 upwards in a slot in the cover, the spring 33 is released to press against the inner envelope surface of the roll 14. To provide a guide for the roll to the right position in the cover, the cover is provided with tapering guide surfaces 35, which also are holders against spring force, provided by the spring 33.

Figure 6:
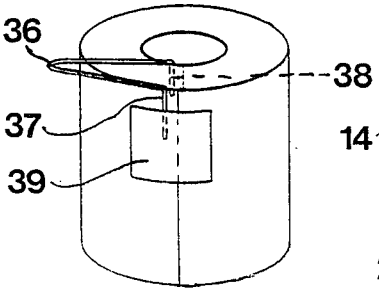
FIG. 6 shows in perspective a paper roll provided with a force generating means acting upon the roll.

The force arresting the material track to the roll can besides through adhesion also be mechanically mounted directly on the paper roll, as demonstrated in the embodiment according to FIG. 6, where the force is provided by a press member formed by an U-formed spring wire 36. From each shank end there extends one angularly bent arm 37 and 38, one of which 37 by means of a tape is fixed to the roll 14, while the other arm 38 by the spring force bears against the inside of the roll.

Figure 7:
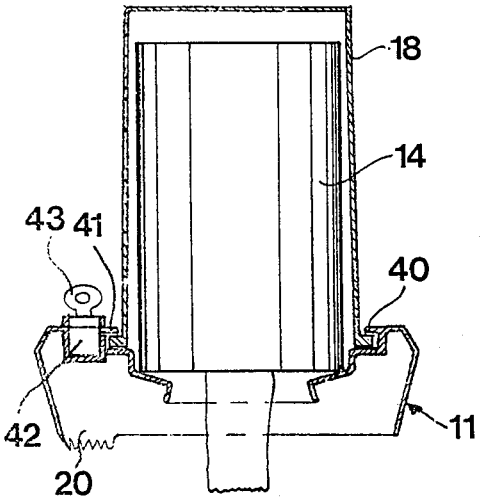
FIG. 7 is a section through a fourth embodiment of the dispenser.
Figure 8:
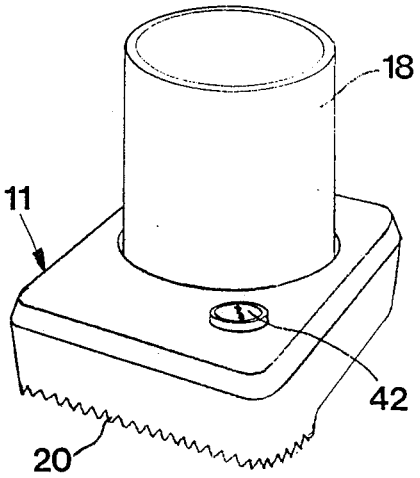
FIG. 8 shows in perspective the dispenser illustrated in FIG. 7.

A simplified embodiment of the fixing arrangements of the disk 11 and the cover 18 is shown in the embodiment according to FIGS. 7 and 8, where on diametrically opposite sides of the ringshaped groove 16 of the disk, there are arranged a tongue 40 and a locking member 42. By means of a key 43 or the like a lock bolt 41 can be turned into the groove 16 and over the edge 17 of the cover, provided with a flange, so that the cover cannot be taken away without admittance.

The invention is not limited to the shown and described embodiments, but several varations and combinations therebetween are possible within the scope of the claims. Therefore, the reeling off of the paper web from the roll need not necessarily be done from the inside, but can also be done from the outside of the roll. In this case the roll is suitably fixed through the centre hole to a pin extending vertically downwards from the top of the cover on which pin the roll is threaded and fixed.

We claim:

1. A dispenser for a material web, particularly a paper web, comprising a tubular roll of the web, the roll having an axis about which the web is wound, an upper end face, a lower end face, an inner side and an outer side, and a holder for supporting the roll with its axis substantially vertical, the holder having an opening therethrough which is located at a lower surface of the dispenser directly adjacent the lower end face of the tubular roll, said web having a free end depending from inside the roll at the lower end face thereof and being unwindable from the inner side of the roll in a downward direction through the opening, the weight of said free end causing a tendency for the web to unwind by gravity; and means for preventing unwanted unwinding of the web by gravity, said means including means for causing adhesion between adjacent overlying coils of the web inside the roll such that unwinding by gravity is restrained yet manual pulling downwardly on the free end overcomes the adhesion to allow unwinding of the web.

2. A dispenser as in claim 1 wherein the adhesion between adjacent coils is smaller than the tearing strength of the material web.

3. A dispenser as in claim 2 wherein said means includes adhesive material provided to interconnect each two adjacent coils of web in the roll, the adhesive effect of said adhesive material being great enough to prevent said material web from being unwound from said roll solely by the weight of the material web.

4. A dispenser as in claim 3 wherein said adhesive material is in the form of a strip of adhesive material upon at least one of the end faces of said roll and extending between the outer and inner sides of said roll.

5. A dispenser as in claim 3 wherein said adhesive material is comprises longitudinally spaced apart spots on a surface of the web.

6. A dispenser as in claim 2 wherein said means includes at least one deformation zone provided in the end faces of the tubular roll, whereby the material is deformed such that at least a tab of material in each coil of the roll is deformed to engage in a corresponding aperture in the adjacent coil of the roll thereby to keep the coils together.

7. A dispenser as in claim 2 wherein said means includes at least one stop arm biased by a spring to press against the inner side of the tubular roll, and an operating arm acting on said stop arm for displacing the latter against the action of said spring from its position of contact with the inner side of the roll.

8. A dispenser as in claim 7 wherein said means acts on the inner side of the tubular roll at the upper end of the roll, said dispenser including a cover to enclose the roll, and a guiding member inside said cover to guide the upper end of the roll to a position substantially adjacent said stop area.

9. A dispenser as in claim 2 wherein said means includes a pressure member fixedly attached to said roll and pressing against the inner side of said roll.

10. A dispenser as in claim 9 wherein said means acts on the inner side of the tubular roll at the upper end of the roll, said dispenser including a cover to enclose the roll, and a guiding member inside said cover to guide the upper end of the roll to a position substantially adjacent said pressure member.

11. A dispenser for a material web, particularly a paper web, comprising a tubular roll of the web, the roll having a length dimension and a width dimension, a holder for supporting the roll with its length dimension substantially vertical, said holder including a horizontal bottom wall having an opening therein which is only slightly smaller than the cross-section of the roll of the web, and the roll being supported by the bottom wall only at the periphery of the roll, said web having a free end depending from inside the roll at the lower end face thereof through said opening and being unwindable from the inner side of the roll in a downward direction through the opening, the weight of said free end causing a tendency for the web to unwind by gravity; and means for preventing unwanted unwinding of the web by gravity, said means including means for causing adhesion between adjacent overlying coils of the web inside the roll throughout the width dimension of the roll such that unwinding by gravity is restrained yet manual pulling downwardly on the free end overcomes the adhesion to allow unwinding of the web.

* * * * *